US005152699A

United States Patent [19]

Pfeifer

[11] Patent Number: 5,152,699

[45] Date of Patent: Oct. 6, 1992

[54] FILTERED PLUG CONNECTOR

[75] Inventor: Hans-Dieter Pfeifer, Lautertal, Fed. Rep. of Germany

[73] Assignee: Thomas & Betts Corporation, Bridgewater, N.J.

[21] Appl. No.: 796,563

[22] Filed: Nov. 21, 1991

[30] Foreign Application Priority Data

Nov. 27, 1990 [DE] Fed. Rep. of Germany ..... 4037602

[51] Int. Cl.[5] ..... H01R 13/66

[52] U.S. Cl. ..... 439/620; 333/185

[58] Field of Search ..... 439/608, 620; 333/181-185

[56] References Cited

U.S. PATENT DOCUMENTS

| | | | |
|---|---|---|---|
| 4,500,159 | 2/1985 | Briones et al. | 439/620 |
| 4,582,385 | 4/1986 | Couper et al. | 439/620 |
| 4,707,048 | 11/1987 | Gliha et al. | 439/620 |
| 4,930,200 | 6/1990 | Brush, Jr. et al. | 29/25.42 |
| 4,950,185 | 8/1990 | Boutros | 439/620 |
| 5,057,041 | 10/1991 | Yu et al. | 439/620 |

FOREIGN PATENT DOCUMENTS 0385259 9/1990 European Pat. Off. .

OTHER PUBLICATIONS

Patents Abstracts of Japan E-982, Sep. 21, 1990, vol. 14, No. 444.

Patents Abstracts of Japan E-882, Jan. 31, 1990, vol. 14, No. 55.

*Primary Examiner*—Gary F. Paumen

*Attorney, Agent, or Firm*—Robert M. Rodrick; Salvatore J. Abbruzzese

[57] ABSTRACT

The invention concerns a filtered plug connector comprising a housing and plug pins which are held therein. The filtering of high-frequency signals to ground is achieved by multi-layer ceramic capacitors electrically connected between the plug pins and a ground plate. For mechanically fixing same, the capacitors are resiliently clamped between the plug pins and bent, resilient portions which project from the ground plate adjacent openings in the ground plate through which the pins pass.

12 Claims, 2 Drawing Sheets

FILTERED PLUG CONNECTOR

FIELD OF THE INVENTION

The invention relates to an electrical connector and, in particular to a plug comprising a housing, a ground plate lying on the inside thereof, bores passing through the housing and openings in the ground plate, plug pins which pass through the bores and the openings and which are held in the former, and multi-layer ceramic capacitors which are arranged on the inside of the housing and which are disposed electrically between the ground plate and the plug pins.

BACKGROUND OF THE INVENTION

Such plugs are known, one of which is shown, for example, in U.S. Pat. No. 4,930,200, to Brush, et al. Plugs of that kind serve for connecting printed circuit boards to other electrical components. The plug pins thereof are inserted with their one ends into the metallized holes in the printed circuit board. Their other ends extend for example to the wires of a cable. In the transmission of the useful signals from the printed circuit board to the cable, high-frequency signals or interference signals are to be removed. The multi-layer ceramic capacitors which are disposed between a ground plate and the plug pins are provided for that purpose. The capacitors are of dimensions of only a very few millimeters and they are arranged on a printed circuit board which is fixed in the plug. Their metallized ends are soldered to conductor tracks of the circuit board. In many cases, they are additionally glued onto the circuit board. In other words, they are rigidly connected thereto. Accordingly, they follow the movements of the circuit board, even if such movements are slight. The circuit board may be twisted and flexed when it is fitted into the plug housing and when the ground plate is clamped in position. Those movements which may also be imposed on the multi-layer ceramic capacitors which could result in their being damaged. Because the capacitors are made of ceramic material, the multi-layer ceramic capacitors are very brittle. In regard to the known plug, it should be noted that the printed circuit boards represent a particular component and serve only for mechanical and electrical connection of the multi-layer ceramic capacitors.

SUMMARY OF THE INVENTION

Taking that state of the art as its basic starting point, the invention is based on the provision of a plug in which high-frequency interference signals are carried away to ground and the multi-layer ceramic capacitors of which are not subjected to a mechanical loading and which can also be produced cost effectively. The solution to that problem is achieved in a plug of the kind set forth in the opening part of this specification, in accordance with the invention, in that the multi-layer ceramic capacitors are resiliently clamped between the ground plate and the plug pins.

In accordance with the invention therefore the multi-layer ceramic capacitors are disposed directly between the ground plate and the plug pins and are resiliently clamped between same and are not fitted onto an additional component, such as a printed circuit board. Such arrangement therefore omits the rigid connection to the printed circuit board and the resulting risk of breakage. Finally, the arrangement also omits the printed circuit board itself, as an additional cost-incurring component.

The elasticity of the ground plate is considered sufficient to clamp the multi-layer ceramic capacitors in position resiliently and nonetheless securely. The capacitors are sufficiently securely held in place from the mechanical point of view. The pressure applied by the ground plate is also sufficient to provide a sound electrical connection. Nevertheless the manner in which the multi-layer ceramic capacitors are held in position between the plug pins on one side and the ground plate on the other side is not rigid. As such, the multi-layer ceramic capacitors do not follow all possible movements, and as a result they are not subjected to a mechanical loading and the risk of breakage is reduced.

In order to provide a sufficiently large contact or pressure area as between the multi-layer ceramic capacitors and the ground plate, a desirable configuration provides that the openings in the ground plate are surrounded by plate portions which are bent out of the ground plate towards the housing. The height of such plate portions corresponds at least to the thickness of the multi-layer ceramic capacitors, and the latter are clamped between the plate portions and the plug pins. The plate portions have a flat section extending parallel to the end faces of the multi-layer ceramic capacitors. The length of the plate portions approximately corresponds to the height or thickness of the multi-layer ceramic capacitors. The flat section bears against the end faces or metallized ends of the multi-layer ceramic capacitors.

So that the ground plate bears in its other regions against the housing of the plug and is not held at a spacing therefrom by its outwardly bent plate portions, a further desirable configuration provides that disposed on the inside of the housing are recesses and the plate portions are bent into said recesses. Furthermore, in another advantageous configuration, a plate lies on the ground plate, the plate having protrusions which are aligned with the openings in the ground plate and the multi-layer ceramic capacitors and bearing against the capacitors. The protrusions of the plate additionally fix the multi-layer ceramic capacitors. Likewise they additionally fix the ground plate.

The multi-layer ceramic capacitors may be arranged on one or both sides of the plug pins.

When a multi-layer ceramic capacitor is disposed only on one side of the plug pin, desirably, at the side of the plug pin which is remote from the multi-layer ceramic capacitor, the housing has a support which bears against the plug pin. In addition at the side of the multi-layer ceramic capacitor which is remote from the protrusion of the plate, the housing may have a support which bears against the capacitor. The supports are formed integrally with the housing. The first-mentioned support bears against a plug pin and the additionally mentioned support bears against a multi-layer ceramic capacitor. By virtue of that arrangement those components are additionally supported and fixed in position.

Depending on the requirements of the respective plug, they may also be soldered with one of their metallized ends to a plug pin and with their other metallized end to the inwardly bent plate portions of the ground plate.

There are uses in which the plugs are exposed to shocks, shaking movements and/or vibration. For such uses, an embodiment is recommended in accordance with the invention in which depressions are provided on the inside of the housing to receive the multi-layer ceramic capacitors and the latter are disposed in the depressions. The dimensions of the depressions are so matched to those of the multi-layer ceramic capacitors that they are positively held in the depressions.

The above-described manner of mounting the multi-layer ceramic capacitors in a plug, in accordance with the invention, may also be used in relation to other components. It is also part of the present invention if other components such as inductors, resistors or capacitors of another type are held in the plugs in the described manner.

BRIEF DESCRIPTION OF THE DRAWING

The invention will now be further described by way of example by means of the embodiments shown in the drawing in which.

DETAILED DESCRIPTION OF THE PREFERRED EMBODIMENT

Figure 1:
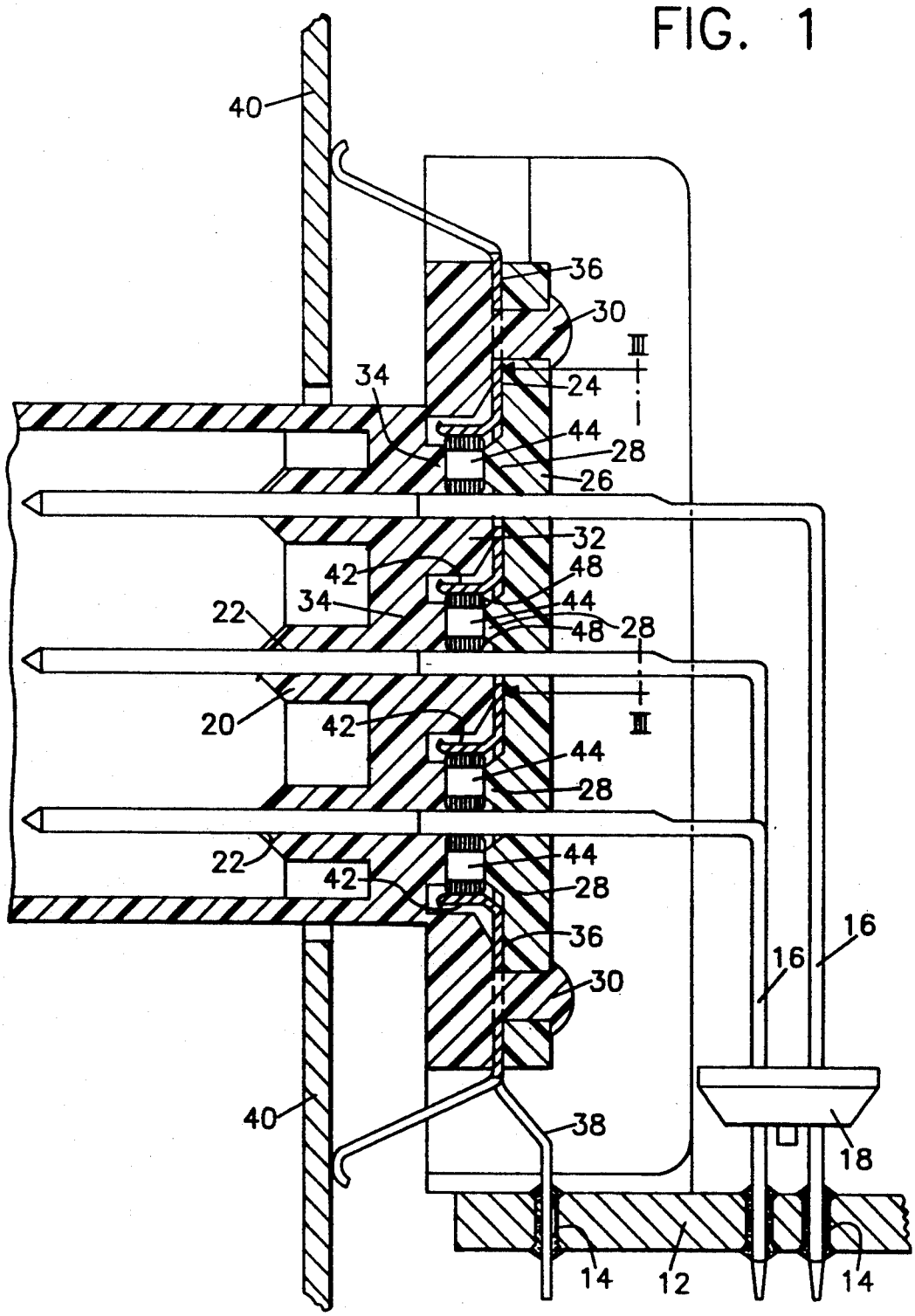
FIG. 1 is a partly sectional side view of a first embodiment of a plug connector.

FIG. 1 shows a part of a printed circuit board 12 with metallized holes 14. Plug pins 16 are fitted into the latter. Some of the plug pins 16 are held together and fixed with a plate portion 18.

FIG. 1 shows the housing 20, insofar as is essential for the present invention. Bores 22 pass through the housing 20 and accommodate the plug pins 16. A plate 26 lies on the inside 24 of the housing 20, with the interposition of the ground plate which is to be described hereinafter. The plate 26 has protrusions 28. The protrusions 28 bear against the multi-layer ceramic capacitors which are to be described hereinafter. FIG. 1 also shows rivet heads 30 which are formed integrally with the housing 20. They pass through openings in the plate 26 and fix the plate 26 to the housing 20.

FIG. 1 shows three plug pins 16. In regard to the two upper plug pins 16, the multi-layer ceramic capacitors to be described hereinafter are disposed only at the top side thereof. In the case of the lower plug pin 16, the multi-layer ceramic capacitors are disposed on both sides thereof. In the case off the two upper plug pins 16 the housing 20 has supports 32 which are formed integrally therewith. The supports 32 engage under and fix the plug pins 16. In that way the pins are protected from being bent.

In the case of all plug pins 16 or multi-layer ceramic capacitors, the housing further has supports or protuberances 34. The supports 34 are also formed integrally with the housing 20 and bear against the lefthand side of the multi-layer ceramic capacitors. In that way the capacitors are fixed in a lateral direction between the protrusions 28 and the supports 34.

A ground plate 36 lies on the inward side 24 of the housing 20. A front plate 40 is disposed on the other side of the housing 20. A ground conductor 38 which is connected to the ground plate 36 is inserted into a metallized hole 14. The ground plate 36 also bears with resilient ends against the inward side of the front plate 40. The ground plate 36 has openings surrounding the plug pins 16. The openings have plate portions 42 which are bent out towards the left, when looking at FIG. 1. The plate portions include flat sections which lie against an end of the above-mentioned multi-layer ceramic capacitors 44.

As shown in FIG. 1, the multi-layer ceramic capacitors 44 are respectively disposed between a plug pin 16 and a plate portion 42. In that arrangement, a respective multi-layer ceramic capacitor bears against each of the two upper plug pins 16 while two such capacitors bear against the lower plug pin 16. The multi-layer ceramic capacitors 44 have metallized ends 46. They can be soldered to the plug pins 16 and the outwardly bent plate portions 42, thereby providing solder locations 46.

Figure 2:
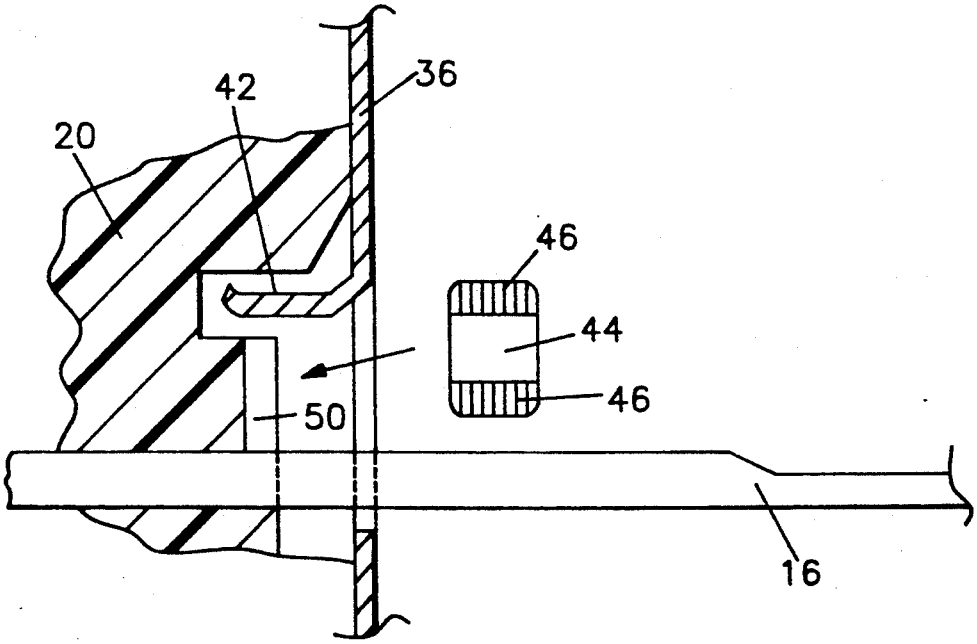
FIG. 2 is a partly sectional side view of a second embodiment illustrating the depression accommodating a multi-layer ceramic capacitor.
Figure 3:
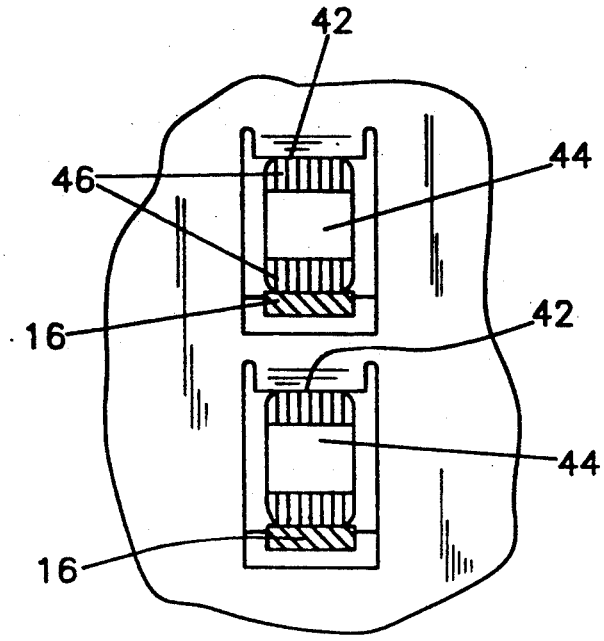
FIG. 3 is a view taken along line III—III in FIG. 1.

As shown in FIG. 2, provided in the inward side of the housing 20 are depressions 50. The dimensions thereof are practically identical to those of a multi-layer ceramic capacitor 42. Each capacitor is pressed into a depression 50 in the direction of the arrow shown i FIG. 2 and then positively held therein. FIG. 3 shows a region from FIG. 1. When looking at the drawing, multi-layer ceramic capacitors 44 each bear from above against a plug pin 16, by way of one of their metallized ends 46.

The true scope of the invention is set forth in the claims appended hereto.

I claim:

1. A filtered plug connector comprising a housing having a plurality of bores through which a respective plurality of pins pass, a ground plate supported by said housing, a plurality of multi-layer capacitors of the type comprising a pair of spaced external electrodes, one electrode of each capacitor being in engagement with a respective pin and the other electrode of each capacitor being in engagement with the ground plate, and a separate support plate supported by said housing holding said capacitors thereagainst in a, said ground plate comprising a resilient portion projecting outwardly from the ground plate for each capacitor, each said resilient portion resiliently engaging one of said capacitor electrodes and pressing said capacitor between said housing and said support plate toward said pin to thereby cause engagement of said other capacitor electrode with said pin.

2. A filtered plug connector as claimed in claim 1, wherein said ground plate has a plurality of openings through which said respective plurality of pins extend, said ground plate being interposed between said housing and said support plate.

3. A filtered plug connector as claimed in claim 2, wherein said support plate is secured to said housing.

4. A filtered plug connector as claimed in claim 3, wherein said pins are generally elongate defining a longitudinal axis, said multi-layer capacitors being of parallelepiped configuration and supported between said housing and said support plate in a direction generally transverse to the axis of a respective pin, said housing and said support plate bearing against each said capacitor on respective opposite surfaces thereof and substantially preventing movement of each said capacitor in a direction along the pin axis, the resilient portion of the ground plate providing resilient clamping of the capacitor against the pin in a direction transverse to each said pin axis.

5. A filtered plug connector as claimed in claim 4, wherein said resilient portions are adjacent the respective openings in the ground plate and are bent out of the ground plate towards the housing.

6. A filtered plug connector as claimed in claim 5, wherein recesses are provided on the inside of the housing and the plate portions are bent into said recesses.

7. A filtered plug connector as claimed in claim 4, wherein said plate has protrusions which are aligned with and extend into the openings in the ground plate and bear against one surface of the multi-layer capacitors.

8. A filtered plug connector as claimed in claim 7, wherein at the surface of the multi-layer ceramic capacitor which is opposite the protrusion of the support plate, the housing has a support bearing against such surface of the capacitor.

9. A filtered plug connector as claimed in claim 4, wherein at a side of the plug pin which is remote from the multi-layer ceramic capacitor the housing has a support which bears against such side of the plug pin.

10. A filtered connector as claimed in claim 4, wherein depressions are provided on the inside of the housing receiving respectively the multi-layer ceramic capacitors.

11. A filtered plug connector as claimed in claim 1, wherein the multi-layer ceramic capacitors are soldered with a metallized electrode to the plug pins.

12. A filtered plug connector as claimed in claim 11, wherein the multi-layer ceramic capacitors are soldered with another metallized electrode to the plate portions of the ground plate.

* * * * *